United States Patent [19]

Ueda et al.

[11] 4,243,746

[45] Jan. 6, 1981

[54] DISPERSION IMAGING MATERIAL AND METHOD OF PRODUCING IMAGE THEREON

[75] Inventors: Takeshi Ueda; Shozo Kinoshita, both of Fuji; Kiichiro Sasaguri, Tokyo; Hidehiko Kobayashi, Fuji, all of Japan

[73] Assignee: Asahi Kasei Kogyo Kabushiki Kaisha, Osaka, Japan

[21] Appl. No.: 17,661

[22] Filed: Mar. 5, 1979

[30] Foreign Application Priority Data

Sep. 3, 1978 [JP] Japan ..... 53/25976

[51] Int. Cl.[3] ..... G03C 5/04; G03C 5/24; G03C 1/76

[52] U.S. Cl. ..... 430/346; 430/348; 430/502; 430/523; 430/961; 430/322; 430/275; 430/271; 430/496; 427/53.1; 427/56.1; 428/457; 428/913; 250/316.1; 250/317.1; 430/269

[58] Field of Search ..... 96/27 E, 27 R, 48 QP, 96/67, 68; 427/53, 56, 53.1, 56.1; 428/457, 913; 346/135, 76 R, 76 L, 135.1; 250/316, 317, 316.1, 317.1; 430/346, 348, 269, 502, 523, 961, 322, 275, 271, 496

[56] References Cited

U.S. PATENT DOCUMENTS

| | | | |
|---|---|---|---|
| 3,707,372 | 12/1972 | Hallman et al. | 96/27 E |
| 3,843,394 | 10/1974 | Katayama et al. | 96/67 |
| 3,996,057 | 12/1976 | Kawaziri et al. | 96/67 |
| 4,000,334 | 12/1976 | Hallman et al. | 96/48 QP |
| 4,137,078 | 1/1979 | Izu et al. | 96/48 QP |

FOREIGN PATENT DOCUMENTS

| | | | |
|---|---|---|---|
| 1286503 | 8/1972 | United Kingdom | 96/27 E |
| 1507728 | 4/1978 | United Kingdom | 96/67 |

*Primary Examiner*—Won H. Louie, Jr.

*Attorney, Agent, or Firm*—Sprung, Felfe, Horn, Lynch & Kramer

[57] ABSTRACT

A novel dispersion imaging material comprising a substrate, a sublayer thereon comprising at least 70% by weight of a member selected from palladium, gold, germanium and combinations thereof and having a thickness of 5 Å to 200 Å, and a main imaging layer on said sublayer comprising at least 50% by weight of tin, and optionally as the outermost layer a protective layer comprising an organic polymer. The sublayer modifies the layer structure of the tin-based main imaging layer. The imaging material has a high safety in respect of toxicity as well as an excellent gradation and a high sensitivity. The imaging material can form thereon an image by a dry process even in a light room without the conventional development and fixation steps.

9 Claims, 2 Drawing Figures

DISPERSION IMAGING MATERIAL AND METHOD OF PRODUCING IMAGE THEREON

Figure 1:
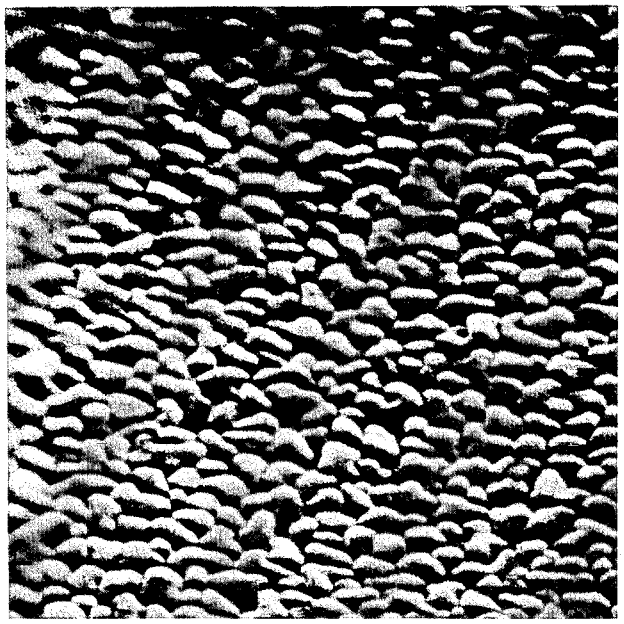

The present invention relates to an imaging material. More particularly, the invention relates to a dispersion imaging material having a high safety in respect of toxicity as well as an excellent gradation and a high sensitivity.

In Japanese Patent Application Laid-Open Specifications Nos. 19303/1973 and 59626/1976, there are proposed imaging materials of the characters such as described below:

(1) The imaging material comprises a substrate and a dispersion imaging layer deposited on the substrate and made of a metal having a relatively low melting point, such as tellurium, bismuth or tin;

(2) The imaging material is exposed to strong energy emitted from a xenon flash lamp or the like;

(3) When the imaging layer of the imaging material absorbs the energy in an amount above a certain critical threshold value, the metal imaging layer is molten at the areas where subjected to said energy;

(4) The molten metal imaging layer is contracted and dispersed into minute globules by its surface tension;

(5) The optical density of the imaging layer is decreased at the areas where the metal imaging layer is molten and dispersed; and (6) Accordingly, a difference in optical density appears in the imaging layer between the areas where subjected to said energy and the areas where not subjected to said energy, whereby an image is formed.

The term "dispersion" as used herein is intended to mean a phenomenon that a continuous, thin solid film of a material becomes discontinuous when the energy absorbed in the material exceeds a certain critical threshold value upon application of the energy. Therefore, the term "dispersion imaging layer" is intended to mean a layer made of a material capable of bringing about the above defined "dispersion".

The imaging material as mentioned above is characterized in that it can form thereon an image by a dry process even in a light room without the conventional development and fixation steps. Utilizing the characteristics as mentioned above, the imaging material may be employed as a microfilm. In this case, since the imaging material has "add-on" and "annotation" abilities (ability of forming an additional image on the non-imaged areas of an imaged material) which is difficult to obtain in conventional imaging materials, it is suited for the "active use" of the microfilm, the meaning of which is that in addition to the storage of information, the microfilm is efficiently used with respect to information recorded thereon, for example, it is classified so as to facilitate the retrieval of information.

However, the metal used for the dispersion imaging layer of the imaging material often tends to evaporate in part when exposed to strong energy. This is especially true where a metal having a high vapor pressure is used for the dispersion imaging layer, and in this case, the imaging material involves, in its practical use, serious problems such as those of hazardous properties due to the toxicity of the metal, those of staining properties and environmental pollution.

An imaging material is desired to have an excellent resolution, and when it is used in the field of microfilms, it is required to have a gradation. In addition, the imaging material is desired to have a high sensitivity from the viewpoint of cost at the time of its practical use and in relation to the performance and life of an apparatus for image formation.

From the foregoing points of view, representative metals for the dispersion imaging layer of an imaging material have their respective characters as follows. Tellurium is defective in its toxicity, and provides only a low sensitivity and an insufficient resolution, and almost no gradation. Bismuth has a relatively high vapor pressure, and provides no gradation and only an insufficient resolution though it provides a high sensitivity. Tin has the advantage of low toxicity, but it provides no gradation and only a low sensitivity.

A principal object of the present invention is to provide an imaging material including a dispersion imaging layer having a high safety in respect of toxicity as well as an excellent gradation and a high sensitivity. Another object of the present invention is to provide a method of producing an image on an imaging material of the character as described above.

Figure 2:
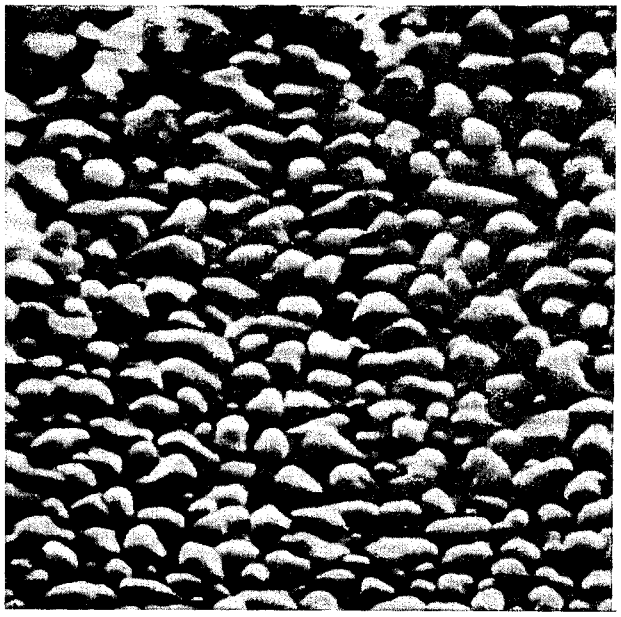

The foregoing and other objects, features and advantages of the present invention will be apparent to those skilled in the art from the following detailed description and appended claims taken in connection with the accompanying drawings in which:

FIG. 1 is a microphotograph of a tin layer vacuum-deposited directly on a polyester film in the same manner as in Comparative Example 1 but having no protective layer thereon, said microphotograph being taken at 36,000 x magnification by using a scanning electron microscope; and FIG. 2 is a microphotograph of a tin layer vacuum-deposited on a vacuum-deposited palladium sublayer on a polyester film in the same manner as in Example 1 but having no protective layer thereon, said microphotograph being taken at 36,000 x magnification by using a scanning electron microscope.

We have focused our research on the low toxicity of tin, and made intensive investigations with a view to developing an imaging material including a dispersion imaging layer comprising tin and, nevertheless, having an excellent gradation and a high sensitivity. As a result, we have found an effective means for improving the gradation and sensitivity of the imaging material having a tin-based imaging layer, and have completed the present invention.

More specifically, in accordance with the present invention, there is provided a dispersion imaging material comprising a substrate; a sublayer formed on the substrate, comprising at least 70% by weight of a member selected from the group consisting of palladium, gold, germanium and combinations thereof and having a thickness of 5 Å to 200 Å; and a main imaging layer formed on the sublayer and comprising at least 50% by weight of tin. The sublayer modifies the layer structure of the main imaging layer, thereby to contribute to the improvements in gradation and sensitivity of the main imaging layer. As will be described later in more detail, the object of provision of the sublayer resides in the modification of the layer structure of the main imaging layer. Accordingly, the sublayer must be provided on the substrate prior to the provision of the main imaging layer, and is characterized in that the thickness thereof may be about one eightieth to about one fifth as small as that of the main imaging layer.

In the dispersion imaging material having such a construction as mentioned above according to the present invention, the improved sensitivity may be due to the presence of strain in the interior structure of the main imaging layer and the improved gradation may be due to the nonuniformity in the distribution of such strain in the interior structure.

Referring now to FIGS. 1 and 2 which are microphotographs taken at 36,000 x magnification by using a scanning electron microscope Model JSM-2 (trade name of a product manufactured and sold by Nihon Denshi K. K., Japan), a detailed explanation will be made. FIG. 1 shows a tin layer vacuum-deposited directly on a polyester film in the same manner as in Comparative Example 1 but having no protective layer thereon. FIG. 2 shows a tin layer vacuum-deposited on a vacuum-deposited palladium sublayer on a polyester film in the same manner as in Example 1 but having no protective layer thereon. This construction is of the present invention. When comparison is made between FIG. 1 and FIG. 2, the marked difference of grain structure will be recognized between the tin layer with no sublayer and the tin layer with the palladium sublayer provided thereunder. It is noted at sight of FIG. 1 that the tin layer with no sublayer is a dense gathering of grains relatively uniform in size, and has a relatively even surface. On the other hand, it is to be noted at sight of FIG. 2 that the tin layer with the palladium sublayer provided thereunder is a gathering of large and small grains relatively far apart from each other, and has an uneven surface. Such a modified layer structure as is seen in FIG. 2 is also observed in tin layers deposited respectively on a germanium sublayer and on a gold sublayer in place of the palladium sublayer. The modification of the layer structure of the main imaging layer by the provision of the sublayer is believed to be caused by the partial relaxation of the strain in the interior structure of the main imaging layer which strain may serve for the improvement in sensitivity. The nonuniformity in the grain structure of the main imaging layer implies that the partial relaxation of the strain in the interior structure is unevenly caused and that the residual strain in the interior structure is also unevenly distributed, leading to the improvement in gradation. The nonuniform grain structure of the main imaging layer may be due to cohesion of metal atoms during or after the deposition of the main imaging layer, and may be formed in the course of the partial relaxation of the strain produced in the interior structure of the main imaging layer. The nonuniform grain structure due to such cohesion may control the fusion and dispersion of the main imaging layer.

The construction of the dispersion imaging material of the present invention will be explained more specifically.

As a substrate to be used in the dispersion imaging material of the present invention, there can be mentioned films and plates of organic polymers such as polyester, cellulose acetate, nitrocellulose, polyethylene, polypropylene, polyvinyl chloride, polyvinylidene chloride, polyamide, polymethyl methacrylate and polystyrene; and plates of inorganic materials such as glass, ceramics and mica. Organic polymer films and plates are preferred. Of organic polymer films and plates, a polyester film is most preferred because the polyester film has not only a good surface smoothness, an excellent heat-resistance and a low moisture absorption but also a suitable wettability by the molten main imaging layer with the sublayer provided thereunder. However, it is noted that an imaging material having as the main imaging layer a tin layer deposited directly on a polyester film provides almost no gradation and an insufficient sensitivity.

For improving the gradation and sensitivity of the tin-based main imaging layer, a sublayer comprising at least 70% by weight, based on the sublayer, of a member selected from palladium, gold, germanium and combinations thereof must be provided on the substrate prior to the deposition of the main imaging layer. The sublayer may be made either of a single metal selected from palladium, gold and germanium or of an alloy or a mixture composed of at least two metals selected from palladium, gold and germanium. In addition to at least 70% by weight of the metal as specified above, the sublayer may include, in the form of an alloy or a mixture, one or more other metals selected from tin, bismuth, lead, antimony, zinc, aluminum, indium and the like. If the sublayer includes more than 30% by weight of the metal other than palladium, gold and germanium, the sublayer cannot modify the main imaging layer deposited thereon as desired. The sublayer composed of two or more metals may also be in the form of a multilayer construction. The thickness of the sublayer is in the range of from 5 Å to 200 Å, preferably in the range of from 10 Å to 80 Å. The main imaging layer comprising at least 50% by weight, based on the main imaging layer, of tin is deposited on the sublayer deposited on the substrate.

The dispersion imaging material of the present invention is characterized in that (1) the thickness of the sublayer is very small, and in that (2) the construction of the dispersion imaging material is suitably adapted to such a transmission route of energy that the energy enters the main imaging layer and passes therethrough to reach the sublayer. With respect to item (1) above, too large a thickness of the sublayer is liable to result not only in poor gradation and poor dispersibility of the main imaging layer but also in poor resolution which may be due to a gathering of large globules produced by dispersion of the main imaging layer and/or due to the occurrence of crazing in the imaging layer at the time of dispersion. In addition, since palladium, gold and germanium to be used as the sublayer are intrinsically hard to disperse, a large thickness of the sublayer inevitably results in the high minimum optical density (O.D. min) and, hence, results in insufficient contrast of an image produced on the imaging material. With respect to item (2) above, it is noted that the sublayer does not function, in the usual use of the dispersion imaging material of the present invention, as a reflection preventive layer capable of increasing the energy absorption of the imaging layer to provide a high sensitivity. This will be easily understood from the fact that the thickness of the sublayer is extremely small in the imaging material of the present invention as compared with that commonly required of the above-mentioned reflection preventive layer. Nevertheless, the sublayer provided in the imaging material of the present invention serves effectively for the improvement in sensitivity. The dispersion imaging material of the present invention assumes milky white in its surface in some cases, indicating a low surface reflectance. This is due to the modification of the layer structure of the main imaging layer itself, which modification may serve for the improvements in gradation and sensitivity.

Where a main imaging layer comprising at least 50% by weight of tin is deposited directly on a substrate, followed by deposition thereon of such a sublayer as mentioned above and having a thickness within the range as specified hereinbefore, no substantial improvements in gradation and sensitivity are realized. This is so in this case because the layer structure of the main imaging layer cannot be modified.

As described above, a sublayer comprising at least 70% by weight of a member selected from palladium, gold, germanium and combinations thereof is required to be firstly deposited on a substrate in the preparation of the dispersion imaging material of the present invention. When the thickness of the sublayer is taken into consideration, the preferred methods of depositing the sublayer on the substrate may include dry processes such as vacuum evaporation-deposition, sputtering, ion plating and the like. The provision of the sublayer made of two or more metals may be effected according to any of methods similar to those as described hereinafter with respect to the provision of the main imaging layer. During the deposition of the sublayer, the sublayer is often oxidized in part with water absorbed on the substrate and/or with oxygen and/or moisture present in a deposition atmosphere. Even in such a case, the effect as is attained in the present invention is not spoiled.

The main imaging layer of the dispersion imaging material of the present invention may be either made of tin alone or composed in combination of tin and one or more metals other than tin. As other metals, there can be mentioned zinc, aluminum, antimony, indium, lead, selenium, tellurium, bismuth, cadmium and the like. These metals may be used for the modification of tin, such as for the lowering of the melting point and/or for the improvement in the surface tension and/or the stability. The term "stability" as used herein is intended to mean the retention of optical density before or after the use of an imaging material and the maintenance of sensitometric characteristics such as gradation, resolution and sensitivity of an imaging material.

The main imaging layer composed in combination of tin and one or more other metals may be in the form of a multi-layer construction, a mixture or an alloy. The multi-layer construction may be composed of separate layers each selected from a single metal layer, a mixed metal layer and an alloy layer. Representative methods for providing a main imaging layer composed in combination of tin and one or more other metals will be explained more specifically as follows. In one of the methods, tin is deposited on the sublayer which modifies the deposited tin layer, followed by deposition of other metal on the tin layer. In another method, a tin layer is deposited on the sublayer from a boat containing tin and a mixed metal or alloy layer is then deposited on the tin layer from the boat containing tin and a boat containing other metal by effecting simultaneous deposition of tin and said other metal, optionally followed by single deposition of said other metal on the mixed metal or alloy layer. In still another method, tin and one or more other metals are simultaneously deposited on the sublayer to form a mixed metal or alloy layer. The simultaneous deposition may be effected either by using a single boat containing a metal mixture or an alloy or by using a plurality of boats each containing a single metal.

The main imaging layer deposited on the sublayer according to any method must comprise at least 50% by weight, based on the main imaging layer, of tin. The main imaging layer comprising less than 50% by weight of tin is liable to provide insufficient gradation and sensitivity, and may involve a problem of toxicity especially in the case where selenium, tellurium or cadmium is included in the main imaging layer. In the case where tin and one or more other metals are simultaneously deposited on the sublayer, the proportion of tin relative to the total of the metals is necessarily at least 50% by weight, preferably at least 80% by weight, because otherwise the layer structure of the resulting main imaging layer cannot be sufficiently modified.

The main imaging layer may be provided on the sublayer according to a dry process such as vacuum evaporation-deposition, sputtering, ion plating or the like. Since tin is a metal liable to undergo oxidation, the oxide is often formed by the action of water absorbed on the substrate and/or of oxygen and/or moisture present in a deposition atmosphere at the time of tin deposition. The excessive formation of the oxide is not preferred. For example, the proportion of tin in the form of tin oxide should be controlled at a level of at most 20% in terms of atomic percentage based on the total tin, for example, by using a dried substrate and/or by maintaining the pressure of the deposition atmosphere at a low level. The above discussion applies also to the aforementioned metals other than tin.

In the case of a combined use of tin and one or more other metals in the form of a multi-layer construction, an alloy (solid solution or eutectic) of the tin and said one or more metals is often formed in the main imaging layer during or after the deposition of those metals. In this case, however, no disadvantages are caused at all by the formation of such an alloy. Similarly, an alloy of the metal or metals in the main imaging layer and the metal or metals in the sublayer is often formed during or after the deposition of the main imaging layer. However, no disadvantages are caused at all by the formation of such an alloy because even in such a case the layer structure of the main imaging layer can be modified as desired. The modification of the layer structure of the main imaging layer can be confirmed either indirectly by examining the gradation or sensitivity of the resulting imaging material or directly by observing the main imaging layer through a scanning electron microscope.

The thickness of the main imaging layer made of tin alone or composed of tin and one or more metals as mentioned hereinbefore is appropriately determined, with the sensitometric characteristics such as gradation and sensitivity and the optical density of the resulting imaging material being taken into consideration. The thickness of the main imaging layer is preferably in the range of from 200 Å to 2,000 Å. Too large a thickness of the main imaging layer may result in poor gradation and sensitivity. The optical density of the imaging material is generally determined according to a field where the imaging material is used. Where the imaging material is used in the field of microfilms, the optical density is preferably in the range of from 1.0 to 1.8. In general, the optical density of the imaging material varies depending upon the kind and thickness of the sublayer and the material and structure of the main imaging layer made of tin alone or a combination of tin and one or more other metals as mentioned hereinbefore. Therefore, the optical density does not always have a porportional relationship with the thickness of the main imaging layer. For example, when a 20 Å-thick film of palladium is deposited as the sublayer on a polyester film and a layer of tin alone is deposited thereon, the tin layer is required to have a thickness of 450 Å to 800 Å for providing an optical density of 1.0 to 1.8 as is preferred in the field of microfilms.

An additional sublayer made of the same material as that of the aforementioned sublayer may be provided on the main imaging layer in addition to the sublayer between the substrate and the main imaging layer. By doing so, an additional advantageous effect can be obtained though the gradation and sensitivity of the imaging material are not especially improved. In the case of an additional sublayer comprising germanium, the stability of the imaging material is improved to prevent the main imaging layer from undergoing oxidation. In this case, since too large a thickness of the additional sublayer may result in high minimum optical density and poor resolution, the additional sublayer is desired to have a thickness of at most 80 Å. In the case of an additional sublayer comprising palladium and/or gold, the resolution of the imaging material can be improved especially when the thickness of the additional sublayer is 50 Å or less. In this case also, too large a thickness of the additional sublayer may result in high minimum optical density. The additional sublayer may be deposited on the main imaging layer according to a dry process such as vacuum evaporation-deposition, sputtering or the like.

The dispersion imaging material of the present invention preferably includes as the outermost layer remote from the substrate a protective layer comprising an organic polymer. The protective layer protects the imaging layer against damages such as scratch, improves the stability of the imaging material, and in some cases imparts to the imaging material further improved gradation and sensitivity. Specific examples of organic polymers that may be used for providing a protective layer include polyvinylidene chloride, copolymers of vinylidene chloride and acrylonitrile [for example, Saran (trade mark of a product manufactured by Dow Chemical Co., U.S.A.)], polyvinyl acetate, polyvinyl cinnamate, polyisoprene, polybutadiene, polystyrene, polymethyl methacrylate, polyurethanes, polyvinyl butyral, epoxy resins, cellulose acetate, linear saturated polyesters [for example, Vylon (trade mark of a product manufactured by Toyo Boseki K.K., Japan)], fluororubbers [for example, Technoflon (trade mark of a product manufactured by Montedison Co., Italy)], silicone rubbers, silicone resins and silicone varnishes. They may be used either alone or in mixture. Optionally, they may also be used in combination in the form of a multi-layer construction. Of these organic polymers, copolymers of vinylidene chloride and acrylonitrile, linear saturated polyesters, fluororubbers, silicone resins and silicone varnishes are especially preferred. To the organic polymer, there may be added a silicone oil (about 5% by weight or less per polymer), a crosslinking agent (about 20% by weight or less per polymer), an antistatic agent (about 1% by weight or less per polymer), an antiaging agent (about 10% by weight or less per polymer), a surface-active agent (about 5% by weight or less per polymer), etc. for improving processability, film strength and the like. It is preferred to coat a solution of an organic polymer dissolved in an organic solvent. The coating may be effected by spin coating, roll coating or the like. The thickness of the protective layer after drying may preferably be in the range of 0.1$\mu$ to 3$\mu$, more preferably in the range of 0.2$\mu$ to 1$\mu$. From the viewpoint of protection of the imaging layer against damages, a large thickness of the protective layer is preferred, but too large a thickness thereof is not preferred because the reduction of sensitivity and the increase of minimum optical density are entailed.

As described hereinbefore, the dispersion imaging material of the present invention is characterized in that it comprises a sublayer formed on a substrate, comprising at least 70% by weight of a member selected from palladium, gold, germanium and combinations thereof and having a thickness of 5 Å to 200 Å; and a main imaging layer formed on the sublayer and comprising at least 50% by weight of tin. Since the sublayer is extremely thin, the high safety of the imaging material due to the low toxicity of tin is not substantially spoiled. In addition, it is to be noted that the gradation and sensitivity of the imaging material having a tin-based imaging layer is surprisingly improved by the provision of the thin sublayer.

In accordance with another aspect of the present invention, there is provided a method of producing an image by a dry process, which method comprises:

the step of providing a dispersion imaging material comprising a substrate; a sublayer formed on the substrate, comprising at least 70% by weight of a member selected from the group consisting of palladium, gold, germanium and combinations thereof having a thickness of 5 Å to 200 Å; and a main imaging layer formed on the sublayer and comprising at least 50% by weight of tin; and the step of applying to said dispersion imaging material energy in an amount sufficient to increase the absorbed energy in the imaging layer above a certain critical threshold value to decrease the optical density of said imaging layer at the areas where subjected to said applied energy.

Energy above a certain threshold value is applied to the dispersion imaging material of the present invention so that the optical density of the imaging material is decreased at the areas where subjected to said energy to form an image on the imaging material. Energy may be applied to the imaging material either from the side of the substrate of the imaging material or from the side of the imaging material remote from the substrate. However, the application of energy to the imaging material from the side thereof remote from the substrate is preferred because a better resolution can be obtained.

As energy to be applied to the dispersion imaging material of the present invention, there may be employed flash energy emitted from a flash lamp, laser beams, electron beams, infrared rays emitted from a infrared lamp, heat energy by means of a resistance heater or the like. A xenon flash lamp capable of emitting a flash of a short pulse width is most preferred of various flash lamps, and employed suitably for producing an image on the imaging material of the present invention. The imaging material may be irradiated with radient energy emitted from such a lamp through a mask having an appropriately contrasted image, which mask is preferably in close contact with the imaging material, to transfer the image to the imaging material. As the mask, a chromium mask, metal mask, a dry silver film mask, a diazo film mask or the like may preferably be employed. Such a mask may have a continuous tone or gray scale image. Since the dispersion imaging material of the present invention has an excellent gradation, the imaging material is capable of reproducing thereon faithfully even a continuous tone or gray scale image of the mask. In addition, since the imaging material of the present invention has a high sensitivity, only small input energy into a lamp such as a xenon flash lamp is required for image formation, whereby the life of the lamp can be prolonged. In the case of laser beams, energy may be directly applied to the imaging material of the present invention without the use of a mask. In this case, recording of an image in the form of dots is possible.

The dispersion imaging material of the present invention may be used suitably as a microfilm in the form of a roll, a fiche or a card, a copying film, a film for the production of a printing plate or a material for the production of a printed circuit board. Where the imaging material is used as a microfilm in the form of a fiche, an image can be recorded in any frame of the fishe, and an additional image can be recorded in other frame or even in the frame having the image recorded therein. The recorded image can be nullified by application of energy to a whole area covering the image according to need. The imaging material may be subjected to recording by means of laser beams.

The present invention will be further illustrated with reference to Examples. Properties of imaging materials described in Examples and Comparative Examples were measured and evaluated according to the following methods.

(1) Optical Density (O.D.):

Optical Density is measured using Macbeth Transmission Densitometer TD-500 (trade name of a densitometer manufactured in accordance with rules of ASA-PH 2.19-1959 and sold by Macbeth Co., U.S.A.).

(2) Gradation:

A mask of Dry Silver No. 7842 (trade name of a dry silver salt type photosensitive film manufactured and sold by Minesota Mining and Manufacturing Company, U.S.A.) having an image of an 8 step steptablet (manufactured and sold by Eastman Kodak Co., U.S.A.) photographed thereon is placed in close contact with an imaging material. The steptablet has the image wherein the optical density is stepwise changed for the measurement of gradation. The imaging material is exposed through the mask to a flash at 600 volts of a xenon flash lamp (manufactured and sold by EG & G, Inc., U.S.A.) having a pulse width of 50 microseconds and a condenser capacity of 120 $\mu$F which lamp is placed at a distance of 10 mm from the surface of the imaging material.

Optical densities in all the steps of the steptablet image transferred to the imaging material are plotted in relation to the optical densities in the corresponding steps of the steptablet image photographed on the mask, to form a graph having an ordinate representing the optical density of the image on the imaging material and an abscissa representing the optical density of the image on the mask. Gradation is estimated in terms of an inclination of the straight line of the graph. The inclination is referred to as a $\gamma$ value. The smaller the $\gamma$ value, the higher the gradation.

(3) sensitivity:

As input energy into a xenon flash lamp is increased, the optical density of an imaging material subjected to energy emitted from the xenon flash lamp is correspondingly decreased. Utilizing this phenomenon, there is examined input voltage into the xenon flash lamp for giving an optical density of 0.4 to the imaging material located at a distance of 16 mm from the xenon flash lamp. This input voltage is regarded as the sensitivity of the imaging material. The xenon flash lamp (manufactured and sold by EG & G, Inc., U.S.A.) used has a pulse width of 90 microseconds and a condenser capacity of 80 $\mu$F.

(4) Resolution:

A diazo flim mask on which a 1010 resolution test chart in accordance with NBS was photographed is placed in close contact with an imaging material. The imaging material is exposed through the mask to a flash. The obtained image is observed using an optical microscope BHC-312-M type (trade name of an optical microscope manufactured and sold by Olympus Kogaku Kogyo K.K., Japan) and the resolution is measured.

The thicknesses of a sublayer and an imaging layer described in Examples and Comparative Examples are measured by using a digital deposition controller Model DDC-1000 (trade name of a product manufactured and sold by Sloan Technology Corp., U.S.A.) which is located near a substrate.

The following examples illustrate the present invention in more detail so as to further clarify the mode of practice thereof, but are not to be construed as limiting the scope of the present invention because many variations and modifications thereof are possible.

COMPARATIVE EXAMPLE 1

Tin was deposited by vacuum evaporation-deposition technique on a 120 $\mu$-thick polyester film under the following conditions.

| | |
|---|---|
| Rate of deposition: | 10Å/sec |
| Degree of vacuum: | $4 \times 10^{-5}$ Torr |
| Temperature of polyester film: | 30° C. |
| Thickness of deposited tin layer: | 400Å |

After deposition of tin, a 6% by weight solution of Vylon (linear saturated polyester) dissolved in a mixed solvent of methyl ethyl ketone-ethoxyethyl acetate (70/30 by weight) was coated by spin coating technique on the deposited tin layer and dried to form a Vylon layer having a dry thickness of 0.5$\mu$.

The properties of the imaging material thus obtained were as follows.

| |
|---|
| O.D. max (maximum optical density) = 1.40 |
| $\gamma$ = 10 |
| Sensitivity = 1,300 volts |
| Resolution = 100 lines/mm |

EXAMPLE 1

Palladium was deposited by vacuum evaporation-deposition technique on a 120 $\mu$-thick polyester film under the following conditions.

| | |
|---|---|
| Rate of deposition: | 1Å/sec |
| Degree of vacuum: | $2 \times 10^{-5}$ Torr |
| Temperature of film: | 25° C. |
| Thickness of deposited palladium layer: | 20Å |

Subsequently, tin was deposited by vacuum evaporation-deposition technique on the palladium layer under substantially the same conditions as in Comparative Example 1 except that the thickness of the deposited tin layer was 600 Å. The surface of the tin layer assumed a decreased metallic luster and milky white. The same solution of Vylon as used in Comparative Example 1 was coated on the tin layer in the same manner as in Comparative Example 1.

The properties of the imaging material thus obtained were as follows.

O.D. max=1.35
$\gamma$=2.5
Sensitivity=900 volts
Resolution=160 lines/mm

EXAMPLE 2

Gold and germanium were respectively deposited as a sublayer in place of palladium in Example 1 by vacuum evaporation-deposition technique on two pieces of a 120 $\mu$-thick polyester film under substantially the same conditions as in Example 1 except that the thicknesses of the respective sublayers were as indicated in Table 1 below. Tin was deposited by vacuum evaporation-deposition technique on the respective sublayers under the same conditions as in Example 1. Subsequently, the same solution of Vylon as used in Comparative Example 1 was coated on the respective tin layers in the same manner as in Comparative Example 1.

The properties of the imaging materials thus obtained were as shown in Table 1.

TABLE 1

| Sublayer | Thickness of Sublayer (Å) | Properties | | |
|---|---|---|---|---|
| | | O.D. max | Γ | Sensitivity (volt) |
| Gold | 15 | 1.30 | 4.5 | 950 |
| Germanium | 30 | 1.35 | 3.5 | 900 |

EXAMPLE 3

Germanium was deposited by RF sputtering technique (pressure of an argon gas=$5\times10^{-3}$ Torr) on a 170 $\mu$-thick polyester film to form a first germanium layer having a thickness of 40 Å, and tin was then deposited by vacuum evaporation-deposition technique on the first germanium layer under the following conditions.

| | |
|---|---|
| Rate of deposition: | 50Å/sec |
| Degree of vacuum: | $2\times10^{-5}$ Torr |
| Temperature of film: | 40° C. |
| Thickness of deposited tin layer: | 550Å |

Subsequently, germanium was deposited by RF sputtering technique (pressure of an argon gas=$5\times10^{-3}$ Torr) on the tin layer to form a second germanium layer having a thickness of 50 Å.

The properties of the imaging material thus obtained were as follows.

O.D. max=1.30
$\gamma$=4.0
Sensitivity=850 volts

Further, a 3% by weight solution of Saran (copolymer of vinylidene chloride and acrylonitrile) dissolved in methyl ethyl ketone was coated by spin coating technique on the second germanium layer of the above-mentioned imaging material and dried to form a Saran layer having a dry thickness of 0.4$\mu$.

The properties of the imaging material thus obtained were as follows.

$\gamma$=3.5
Sensitivity=800 volts

The imaging material with the Saran layer was improved in stability (as examined after storage for a long time) in comparison with the imaging material without a Saran layer.

COMPARATIVE EXAMPLE 2

Tin was deposited by vacuum evaporation-deposition technique on a 170 $\mu$-thick polyester film under substantially the same conditions as in Example 3 except that the thickness of the deposited tin layer was 400 Å. Germanium was then deposited by RF sputtering technique (pressure of an argon gas=$5\times10^{-3}$ Torr) on the tin layer to form a germanium layer having a thickness of 50 Å. Subsequently, the same solution of Saran as used in Example 3 was coated on the germanium layer in the same manner as in Example 3.

The properties of the imaging materials thus obtained were as follows.

O.D. max=1.30
$\gamma$=12
Sensitivity=1,200 volts
Resolution=110 lines/mm

EXAMPLE 4

The relationship between the thickness of a palladium layer as the sublayer of an imaging material and the properties of the imaging material was examined.

Palladium was deposited by vacuum evaporation-deposition technique on a 120 $\mu$-thick polyester film under substantially the same conditions as in Example 1 except that the thickness of the deposited palladium layer was as indicated in Table 2 below. Tin was then deposited by vacuum evaporation-deposition technique on the palladium layer under the following conditions.

| | |
|---|---|
| Rate of deposition: | 40Å/sec |
| Degree of vacuum: | $3\times10^{-5}$ Torr |
| Temperature of film: | 30–40° C. |
| Thickness of deposited tin layer: | 500Å |

Subsequently, a 4% by weight solution of Technoflon (fluororubber) dissolved in a mixed solvent of methyl ethyl ketone-ethoxyethyl acetate (50/50 by weight) was coated by spin coating technique on the tin layer and dried to form a Technoflon layer having a dry thickness of 0.6$\mu$.

The properties of four kinds of the imaging materials thus obtained and differing in the thickness of the sublayer from one another were as shown in Table 2.

TABLE 2

| Thickness of Sublayer (Å) | Properties | | | |
|---|---|---|---|---|
| | O.D.max | Γ | Sensitivity (volt) | O.D.min |
| 10 | 1.25 | 4.0 | 950 | 0.20 |
| 50 | 1.20 | 3.0 | 900 | 0.20 |
| 100 | 1.50 | 5.0 | 950 | 0.30 |
| 150 | 1.70 | 8.0 | 1,050 | 0.40 |

EXAMPLE 5

Germanium was deposited by RF sputtering technique (pressure of an argon gas=$5\times10^{-3}$ Torr) on a 120 $\mu$-thick polyester film to form a first germanium layer having a thickness of 30 Å, and palladium was then deposited by vacuum evaporation-deposition technique on the first germanium layer under the same conditions as in Example 1 to form a palladium layer having a thickness of 20 Å. Tin was then deposited by vacuum evaporation-deposition technique on the palladium layer under the following conditions.

| | |
|---|---|
| Rate of deposition: | 100Å/sec |
| Degree of vacuum: | $6 \times 10^{-5}$ Torr |
| Temperature of film: | 50° C. |
| Thickness of deposited tin layer: | 600Å |

Subsequently, germanium was deposited by RF sputtering technique (pressure of an argon gas $=5\times10^{-3}$ Torr) on the tin layer to form a second germanium layer having a thickness of 30 Å. The same solution of Saran as used in Example 3 was coated by spin coating technique on the second germanium layer and dried to form a Saran layer having a dry thickness of 0.7μ, and a 1.5% by weight of Syloff 23 (trade name of a silicone resin manufactured by Dow Corning Co., U.S.A.; Syloff is a trade mark) dissolved in n-heptane was then coated by spin coating technique on the Saran layer and dried to form a Syloff layer having a dry thickness of 0.1μ.

The properties of the imaging materials thus obtained were as follows.

O.D. max = 1.30
$\gamma = 3.0$
Sensitivity = 850 volts
Resolution = 160 lines/mm The imaging material was excellent in stability with respect to retention of O.D. max after storage for a long time.

EXAMPLE 6

Palladium was deposited by vacuum evaporation-deposition technique on a 1 mm-thick polymethyl methacrylate plate under substantially the same conditions as in Example 1 to form a palladium layer having a thickness of 40 Å, and tin was then deposited by vacuum evaporation-deposition technique by means of electron beam heating under substantially the same conditions as in Comparative Example 1 to form a tin layer having a thickness of 400 Å. Bismuth was then deposited from a tungsten boat containing the same by vacuum evaporation-deposition technique under the following conditions.

| | |
|---|---|
| Rate of deposition: | 10Å/sec |
| Degree of vacuum: | $4 \times 10^{-5}$ Torr |
| Temperature of plate: | 30° C. |
| Thickness of deposited bismuth layer: | 200Å |

Subsequently, the same solution of Vylon as used in Comparative Example 1 was coated by spin coating technique on the bismuth layer and dried to form a Vylon layer having a dry thickness of 0.2μ.

The properties of the imaging material thus obtained were as follows.

O.D. max = 1.40
$\gamma = 3.0$
Sensitivity : 850 volts

The imaging material could record thereon an image in the form of dots having a diameter of 1μ by means of He-Ne laser beams.

EXAMPLE 7

Germanium was deposited in place of palladium in Example 1 by vacuum evaporation-deposition technique on a 120 μ-thick polyester film under substantially the same conditions as in Example 1 except that the thickness of the deposited first germanium layer was 30 Å. Subsequently, tin was deposited from a tungsten boat containing the same by vacuum evaporation-deposition technique on the first germanium layer under substantially the same conditions as in Comparative Example 1 except that the thickness of the deposited tin layer was 150 Å, and antimony was then deposited from a tungsten boat containing the same by vacuum evaporation-deposition technique on the tin layer simultaneously with the continued deposition of tin under substantially the same conditions as described above except for the thickness of the deposited tin-antimony layer. The rate of antimony deposition was such that antimony would have been deposited at a rate of 2 Å/sec in the single deposition of the same, and the time of simultaneous deposition of tin and antimony was 30 seconds. After the simultaneous deposition of tin and antimony, germanium was deposited by vacuum evaporation-deposition technique on the tin-antimony layer under the same conditions as described above to form a second germanium layer having a thickness of 30 Å. The same solution of Technofon as used in Example 4 was then coated by spin coating technique on the second germanium layer and dried to form a Technoflon layer having a dry thickness of 1.0μ.

The properties of the imaging material thus obtained were as follows.

O.D. max = 1.10
$\gamma = 3.5$
Sensitivity = 900 volts

EXAMPLE 8

Palladium was deposited by RF sputtering technique (pressure of an argon gas $=5\times10^{-3}$ Torr) on a 100 μ-thick polyester film to form a palladium layer having a thickness of 30 Å. Subsequently, tin and lead were simultaneously deposited from two boats containing the same separately by vacuum evaporation-deposition technique on the palladium layer under the following conditions.

| | |
|---|---|
| Rate of deposition: | (tin) 9Å/sec, (lead) 1Å/sec |
| Degree of vacuum: | $1 \times 10^{-4}$ Torr |
| Temperature of film: | 30° C. |
| Thickness of deposited tin-lead layer: | 600Å |

The same solution of Vylon as used in Comparative Example 1 was coated by spin coating technique on the tin-lead layer and dried to form a Vylon layer having a dry thickness of 0.4μ, and the same solution of Technoflon as used in Example 4 was coated by spin coating technique on the Vylon layer and dried to form a Technoflon layer having a dry thickness of 0.5μ.

The properties of the imaging material thus obtained were as follows.

O.D. max = 1.35
$\gamma = 2.5$
Sensitivity = 850 volts
Resolution = 180 lines/mm

EXAMPLE 9

Germanium was deposited by RF sputtering technique [pressure of a mixed gas of argon-oxygen (90/10 by volume)$=7\times10^{-3}$ Torr] on a 120 $\mu$-thick polyester film at a rate of deposition of 25 Å/sec to form a first germanium layer having a thickness of 50 Å. Tin was then deposited from a tungsten boat containing the same by vacuum evaporation-deposition technique on the first germanium layer under the following conditions.

| | |
|---|---|
| Rate of deposition: | 100Å/sec |
| Degree of vacuum: | $4\times10^{-5}$ Torr |
| Temperature of film: | 60° C. |
| Thickness of deposited tin layer: | 600Å |

Subsequently, germanium was deposited by RF sputtering technique on the tin layer in the same manner as described above to form a second germanium layer having a thickness of 50 Å. The first and second germanium layers contained germanium in the form of the oxide thereof in an amount of about 15% in terms of atomic percentage.

The same solution of Technoflon as used in Example 4 was coated by spin coating technique on the second germanium layer and dried to form a Technoflon layer having a dry thickness as indicated in Table 3.

The properties of three kinds of the imaging materials thus obtained and differing in the thickness of a Technoflon layer from one another were as shown in Table 3.

TABLE 3

| Thickness of Technoflon Layer ($\mu$) | $\gamma$ | Properties Sensitivity (volt) | Resolution (line/mm) | O.D. min |
|---|---|---|---|---|
| 0.2 | 3.0 | 900 | 160 | 0.25 |
| 1.0 | 3.0 | 960 | 160 | 0.28 |
| 2.0 | 3.0 | 1,050 | 130 | 0.32 |

EXAMPLE 10

Palladium was deposited by vacuum evaporation-deposition technique on a 120 $\mu$-thick polyester film under the same conditions as in Example 1 to form a palladium layer having a thickness of 20 Å, and tin was then deposited by vacuum evaporation-deposition technique on the palladium layer under substantially the same conditions as in Comparative Example 1 except that the thickness of the deposited tin layer was 300 Å. Subsequently, lead was deposited by vacuum evaporation-deposition technique on the tin layer under the following conditions.

| | |
|---|---|
| Rate of deposition: | 10Å/sec |
| Degree of vacuum: | $4\times10^{-5}$ Torr |
| Temperature of film: | 30° C. |
| Thickness of deposited lead layer: | indicated in terms of weight percentage based on the total of tin and lead in Table 4. |

The same solution of Vylon as used in Comparative Example 1 was coated by spin coating technique on the lead layer and dried to form a Vylon layer having a thickness of 0.5$\mu$.

The properties of four kinds of the imaging materials thus obtained and differing in the thickness of a lead layer from one another were as shown in Table 4.

TABLE 4

| Weight Percentage Tin | Lead | $\gamma$ | Properties Sensitivity (volt) |
|---|---|---|---|
| 90 | 10 | 3.0 | 900 |
| 80 | 20 | 2.5 | 900 |
| 60 | 40 | 5.0 | 1,100 |
| 40 | 60 | 8.0 | 1,200 |

EXAMPLE 11 and Comparative Example 3

Palladium and aluminum were simultaneously deposited from a palladium-aluminum target by RF sputtering technique (pressure of an argon gas$=5\times10^{-3}$ Torr) on a 120 $\mu$-thick polyester film to form a palladium-aluminum layer having a thickness of 30 Å. The composition of the palladium-aluminum target was such that the deposited palladium-aluminum layer included 80% by weight of palladium and 20% by weight of aluminum. Subsequently, tin was deposited by vacuum evaporation-deposition on the palladium-aluminum layer under substantially the same conditions as in Example 3 except that the thickness of the deposited tin layer was 500 Å. The imaging material thus obtained had a $\gamma$ value of 4.0 and a sensitivity of 900 volts.

On the other hand, an imaging material was prepared in substantially the same manner as described above except that the simultaneous deposition of palladium and aluminum was effected so that the deposited palladium-aluminum layer had a thickness of 40 Å and included 50% by weight of palladium and 50% by weight of aluminum. The imaging material obtained had a $\gamma$ value of 8.0 and a sensitivity of 1,100 volts.

What is claimed is:

1. A dispersion imaging material comprising a substrate; a sublayer formed on the substrate and having a thickness of 5 Å to 200 Å, said sublayer consisting of a member selected from the group consisting of palladium, gold, germanium and combinations thereof, or at least 70% by weight of a member selected from the group consisting of palladium, gold, germanium and combinations thereof, and one or more other metals selected from tin, bismuth, lead, antimony, zinc, aluminum and indium; and a main imaging layer formed on the sublayer and consisting of tin, or at least 50% by weight of tin and a member selected from the group consisting of zinc, aluminum, antimony, indium, lead, bismuth, cadmium and combinations thereof.

2. A dispersion imaging material as claimed in claim 1, which further comprises a protective layer comprising an organic polymer.

3. A dispersion imaging material as claimed in claim 1, wherein said substrate is made of an organic polymer.

4. A dispersion imaging material as claimed in claim 2, wherein said protective layer has a thickness of 0.1$\mu$ to 3$\mu$.

5. A method of producing an image by a dry process, which method comprises:

the step of providing a dispersion imaging material comprising a substrate; a sublayer formed on the substrate, comprising at least 70% by weight of a member selected from the group consisting of palladium, gold, germanium and combinations thereof and having a thickness of 5 Å to 200 Å; and a main imaging layer formed on the sublayer and comprising at least 50% by weight of tin; and the step of applying to said dispersion imaging material energy in an amount sufficient to increase the absorbed energy in the imaging layer above a certain critical threshold value to decrease the optical density of said imaging layer at the areas where subjected to said applied energy.

6. A method of producing an image by a dry process, which method comprises:

the step of providing a dispersion imaging material comprising a substrate; a sublayer formed on the substrate, and having a thickness of 5 Å to 200 Å, said sublayer consisting of a member selected from the group consisting of palladium, gold, germanium and combinations thereof, or at least 70% by weight of a member selected from the group consisting of palladium, gold, germanium and combinations thereof; and a main imaging layer formed on the sublayer and consisting of tin, or at least 50% by weight of tin and a member selected from the group consisting of zinc, aluminum, antimony, indium, lead, bismuth, cadmium and combinations thereof; and the step of applying to said dispersion imaging material energy in an amount sufficient to increase the absorbed energy in the imaging layer above a certain critical threshold value to decrease the optical density of said imaging layer at the areas where subjected to said applied energy.

7. A method according to claim 5, wherein said energy is radiant energy having a short pulse width and is applied through a mask having an image thereon to said dispersion imaging material.

8. A dispersion imaging material as claimed in claim 1, wherein said main imaging layer consists of tin, tin and lead, tin and antimony or tin and bismuth.

9. A method according to claim 5, wherein said main imaging layer consists of tin, tin and lead, tin and antimony or tin and bismuth.

* * * * *

UNITED STATES PATENT AND TRADEMARK OFFICE

CERTIFICATE OF CORRECTION

PATENT NO. : 4,243,746

DATED : January 6, 1981

INVENTOR(S) : Takeshi Ueda et al

It is certified that error appears in the above-identified patent and that said Letters Patent are hereby corrected as shown below:

On the title page, Item [30]

"Sep. 3, 1978 [JP]" should read

"March 9, 1978 [JP]"

Signed and Sealed this

*Fifteenth* Day of *September 1981*

[SEAL]

*Attest:*

GERALD J. MOSSINGHOFF

*Attesting Officer*

*Commissioner of Patents and Trademarks*